United States Patent [19]

Downs

[11] Patent Number: 4,532,833

[45] Date of Patent: Aug. 6, 1985

[54] STRAP-TYPE WRENCH FOR REMOVING ROTATABLE CLOSURES OR SIMILAR MEMBERS

[76] Inventor: Edgar S. Downs, P.O. Box 242, Worthington, Ohio 43085

[21] Appl. No.: 573,332

[22] Filed: Jan. 24, 1984

[51] Int. Cl.[3] ..... B25B 13/52

[52] U.S. Cl. ..... 81/64; 81/3.43; 294/31.2

[58] Field of Search ..... 81/64, 3.43, 3.4, 57.17, 81/65; 294/31.2

[56] References Cited

U.S. PATENT DOCUMENTS

| | | | |
|---|---|---|---|
| 643,673 | 2/1900 | Morris | 294/31.2 X |
| 1,625,258 | 4/1927 | Jelbert, Jr. | 81/3.43 X |
| 2,422,715 | 6/1947 | Blake | 81/64 X |
| 2,834,238 | 5/1958 | Stover | 81/64 |
| 3,023,649 | 3/1962 | Wallace | 81/65 X |
| 3,090,115 | 5/1963 | Carr | 81/64 X |
| 4,145,938 | 3/1979 | Laird, Jr. | 81/64 |
| 4,215,890 | 8/1980 | Savage | 294/31.2 |

*Primary Examiner*—Frederick R. Schmidt
*Assistant Examiner*—Debra S. Meislin
*Attorney, Agent, or Firm*—William V. Miller

[57] ABSTRACT

A wrench comprising a handle carrying a flexible strap that is arranged as a loop with both of its ends anchored to the handle. A loop-adjusting slide is mounted on the handle for movement relative to the anchoring point and has the doubled ends of the strap slideably passing through it outwardly of the anchoring point so that movement of the slide adjusts the size of the loop. A ratchet is provided to hold the slide member in loop-tightening position and a spring returns it to its original position upon release of the ratchet.

4 Claims, 6 Drawing Figures

STRAP-TYPE WRENCH FOR REMOVING ROTATABLE CLOSURES OR SIMILAR MEMBERS

BACKGROUND OF THE INVENTION AND PRIOR ART

This invention relates to the general type of wrenches which include a flexible strap that is tightened around a screw-type member to be removed from an object, for example, a screw-type closure to be removed from a container. Prior art devices of this general type have been used in the past for removing screw-type closures as well as other objects, such as removing oil filters or the like from motors. These devices usually consist of a strap loop anchored at one end to a handle with its other end connected to a moveable means on the handle for applying tension to the strap to draw it around the object to be removed. With this type of device it is difficult to tighten the strap sufficiently to obtain the desired grip on the object.

SUMMARY OF THE INVENTION

The wrench of the present invention comprises a handle which carries a flexible strip in the form of a strap that is arranged as a loop with both of its ends anchored in the handle. A loop-adjusting slide member carried by the handle has the doubled ends of the strap slideably passing through it before they are both anchored in the handle. Moving this slide back-and-forth relative to the handle changes the size of the loop for application to or removal from the object to be turned. When the loop is tightened on the object and the handle swung, the slide engages the strap and tightens it more firmly against the object to facilitate turning.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
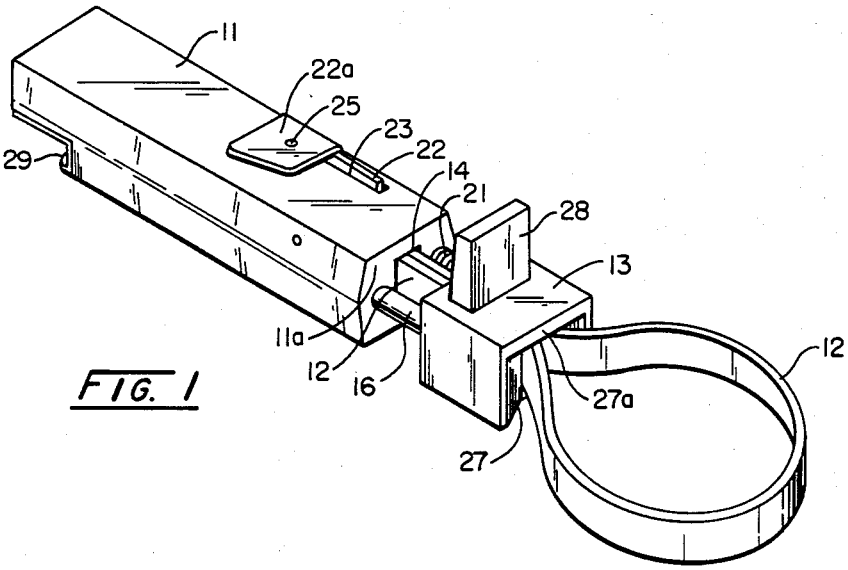
FIG. 1 is a perspective view of the wrench with the slide moved outwardly on the handle.
Figure 2:
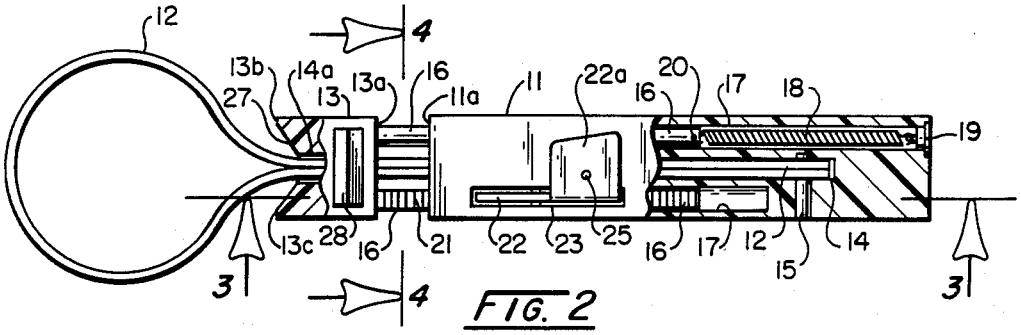
FIG. 2 is a plan view of the wrench.
Figure 3:
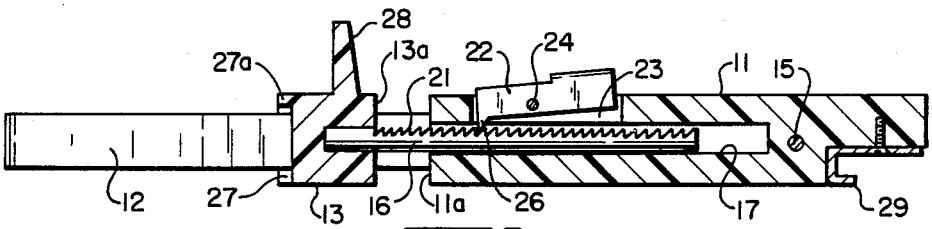
FIG. 3 is a longitudinal sectional view taken along line 3—3 of FIG. 2.
Figure 4:
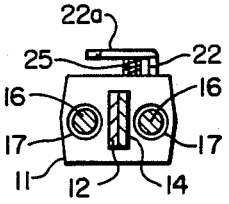
FIG. 4 is a transverse sectional view taken along line 4—4 of FIG. 2.

The present invention is shown as embodied in a wrench consisting of three main parts, namely, an elongated handle 11, a flexible loop 12 and a loop-adjusting member 13. The handle 11 may be of any suitable form for gripping and may be of any suitable material such as plastic. The member 13 may also be of plastic. The loop is formed of a flexible strip preferably a flat strap for example a leather strap, disposed vertically edgewise relative to the flat upper surface of the handle which is shown in horizontal position in FIGS. 2 and 3.

The handle 11 has a socket 14 open at its inner end into which the doubled strap of the loop 12 is inserted and this socket extends along the center line of the handle almost to the outer end of the handle where the strap is firmly anchored to the handle by a transverse anchoring pin 15 which extends only partly through the thickness of the handle.

The loop-adjusting member 13 is of substantially cubical or block form and is slideably mounted for longitudinal movement at the inner end of the handle. The doubled strap is disposed vertically edgewise and passes snugly through a vertical slot 14*a* that extends completely longitudinally through member 13 and aligns with socket 14. It is fixed on the outer ends of a pair of parallel guide rods 16 which are slideably mounted in a pair of outwardly-opening sockets or bores 17 formed in the handle 11. At the inner end of one rod 16 in the socket 17 is a tension spring 18 having its inner end connected to a plug 19 and its outer end connected to the rod at 20. The plug is inserted from the rear end of the handle and is fixed in position. The other rod 16 has ratchet teeth 21 formed on its upper side and cooperating with these teeth is a ratchet pawl 22 mounted in a longitudinal slot 23 in the upper surface of the handle 11 and pivoted at 24 in the handle for vertical rocking movement. A compression spring and pin arrangement 25 mounted in slot 23 beneath the finger-engaging lug 22*a* on the outer end of pawl 22 keeps the tooth 26 thereof normally engaged with the ratchet teeth 21.

Figure 5:
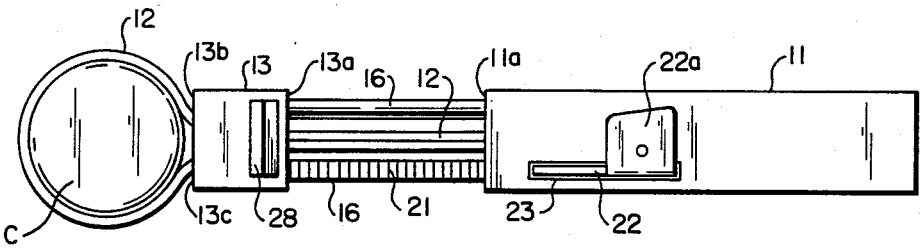
FIG. 5 is a plan view showing the wrench applied to a bottle cap with the loop tightened thereon.
Figure 6:
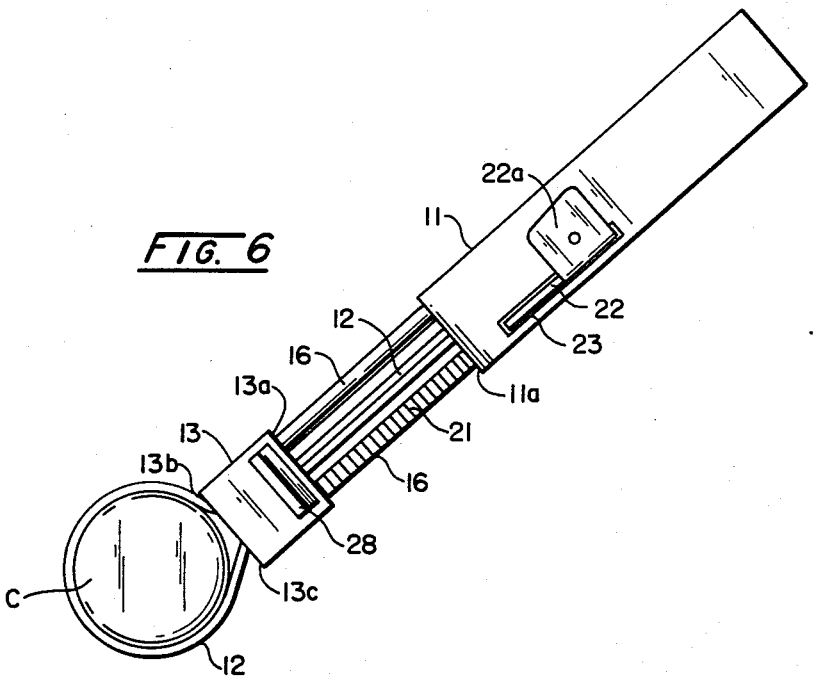
FIG. 6 is a similar view showing the handle being swung to remove the cap.

To initiate the grabbing action of the strap on the object to be turned the loop is slipped down over the object, such as a cap C shown in FIG. 5. The slide 13 is pushed outwardly relative to handle 11 as far as possible by engaging the lug 28 to tighten the loop as much as possible around the cap C, being held in this position by the ratchet mechanism since the pawl 22 is engaged with ratchet teeth 21. When the slide 13 is pushed snugly against the strap, the handle is swung counterclockwise to grip the cap. This causes the corner 13*b* to engage the strap and act as a fulcrum point for the handle 11 which will act as a lever to pull on the other end of the of the loop strap to tightly draw it around the cap and rotate the cap to remove it. Then when the handle 11 is returned to its starting position by reverse or clockwise swinging, the loop 12 is loosened so it can be easily removed from the cap C.

If moved farther clockwise before loosening the loop and the cap is a screw cap or a similar object, the wrench could be used for tightening the cap and at this time the fulcrum point would be at the other corner 13*c*. Loosening of the strap loop about the cap is accomplished merely by pressing on the lug 22*a* to release the ratchet and allowing spring 18 to pull member 13 into contact with the end of the handle.

The forward or inner end of handle 11 has a flat stop surface 11*a* and the adjacent inner surface 13*a* of number 13 has a flat contact surface 13*a*. The outer surface of member 13 preferably has a blunted V-groove 27 formed therein which is open at its bottom and closed at its top 27*a*. A transverse lug 28 is upstanding from the cubical member 13 to be engaged by the thumb when the handle 11 is gripped.

In the normal condition of the wrench when it is not being used, the member 13 will be pulled back into contact with the handle 11, the flat contact surface 13*a* thereof engaging the end 11*a* of the handle 11. The loop 12 at this time will be of its greatest diameter. The spring 18 always automatically returns the member 13 to this retracted position after use when the pawl lug 22*a* is pressed to release the ratchet rod 16.

If desired, the outer end of the handle 11 could be recessed and a bottle cap removing lug 29 of the crown cap prying type mounted therein.

In FIG. 7 there is illustrated a modification of the invention. In this instance the loop 120 is shown as being much larger so it could be used on jar lids or other larger objects to be turned. Also, the slide member 130 mounted on handle 110 does not have the ratchet lock or the spring return. The member 130 will be pushed manually to tighten the loop and be held in that position and will be retracted manually.

It will be apparent that this invention provides a strap-type wrench mainly for loosening and removing rotatable caps, although it could be used on other rotatable objects. Also, it could be used to tighten those objects when replaced. It consists mainly of a strap loop having both ends anchored to a handle, and a slide through which the doubled strap passes to the handle and which is moveable towards the handle to vary the diameter of the loop. The ratchet arrangement keeps the slide in loop-tightening position and the spring arrangement automatically returns it to its original position.

I claim:

1. A wrench comprising an elongated handle with opposed ends, a flexible strip having ends which are overlapped to form a loop, means for anchoring the overlapped ends within the handle at an anchoring point longitudinally thereof with the loop extending outwardly from one end of the handle, a loop-adjusting slide member mounted on the handle at said end for slideable movement in and out relative thereto, said flexible member passing through the slide member into a central socket extending longitudinally from said end of the handle to said anchor point, said slide member being carried by a pair of parallel rods slideably mounted in sockets extending into the handle from said end and being parallel to each other and to the central socket, one of said rods having ratchet teeth formed thereon, a ratchet pawl pivotally mounted on said handle intermediate its length and extending into the socket for said ratchet rod into engagement with the teeth thereof for holding the slide in an outward position when it is moved outwardly of said end of the handle from loop-expanding position into loop-tightening position, a spring acting on the pawl to engage the ratchet teeth, and a spring in the socket of the other rod acting on it to return it to loop-expanding position upon release of the ratchet rod by the pawl.

2. A wrench according to claim 1 in which the flexible member is in the form of a strap of flat cross section providing opposed faces and in which the ends of the strap are disposed in face contact at the anchoring point.

3. A wrench according to claim 2 in which the elongated handle has one substantially flat face through which the pawl projects and has a finger-engaging lug, the said end of the handle being flat, and said slide member being of cubical form and having a slot with the strap passing therethrough, said slide member having a flat inner end for contacting the flat end of said handle.

4. A wrench according to claim 3 in which the cubical slide member has an upstanding finger-engaging pusher lug.

* * * * *